US011307606B2

(12) United States Patent
Byrd et al.

(10) Patent No.: US 11,307,606 B2
(45) Date of Patent: Apr. 19, 2022

(54) PEDAL FRICTION PAD FOR VEHICLE PEDAL ASSEMBLY

(71) Applicant: CTS Corporation, Lisle, IL (US)

(72) Inventors: Christopher M. Byrd, Elkhart, IN (US); Michael L. Wurn, Osceola, IN (US); Thomas A. Hallberg, Goshen, IN (US)

( * ) Notice: Subject to any disclaimer, the term of this patent is extended or adjusted under 35 U.S.C. 154(b) by 0 days.

(21) Appl. No.: 16/553,933

(22) Filed: Aug. 28, 2019

(65) Prior Publication Data

US 2020/0073431 A1 Mar. 5, 2020

Related U.S. Application Data

(60) Provisional application No. 62/725,930, filed on Aug. 31, 2018.

(51) Int. Cl.
*G05G 1/50* (2008.04)
*G05G 1/44* (2008.04)

(52) U.S. Cl.
CPC ..... *G05G 1/506* (2013.01); *G05G 1/44* (2013.01)

(58) Field of Classification Search
CPC ..... G05G 1/506; G05G 1/44
See application file for complete search history.

(56) References Cited

U.S. PATENT DOCUMENTS 4,944,269 A 7/1990 Imoehl
5,408,899 A 4/1995 Stewart
5,524,589 A 6/1996 Kikkawa et al.
5,697,260 A 12/1997 Rixon et al.
5,937,707 A 8/1999 Rixon et al.
6,003,404 A 12/1999 Hannewald
6,070,490 A 6/2000 Aschoff et al.
6,073,610 A 6/2000 Matsumoto et al.
6,098,971 A 8/2000 Stege et al.
6,158,299 A 12/2000 Czajkowski
6,276,229 B1 8/2001 Göhring et al.
(Continued)

FOREIGN PATENT DOCUMENTS

DE 19755980 A1 6/1999
DE 102012111315 A1 5/2014
(Continued)

OTHER PUBLICATIONS

Translation DE 102008003296.*
CTS Series 551 Vehicle Accelerator Pedal Friction Lever Jan. 30, 2015.

*Primary Examiner* — Vicky A Johnson

(57) ABSTRACT

A vehicle pedal assembly comprising a pedal housing. A rotatable pedal includes a drum extending into the pedal housing. The drum includes a friction contact surface. A pedal friction pad extends in the pedal housing and includes a pedal friction surface in contact with the friction contact surface on the drum. The pedal friction surface is shaped and positioned to provide for a line frictional contact between the pedal friction surface and the drum. In one embodiment, the pedal friction surface in contact with the drum is arc-shaped. In one embodiment, the pedal friction surface includes a first curved converging segment, the arc-shaped surface segment defines the second surface segment and extends between the first and a third straight converging segment.

8 Claims, 4 Drawing Sheets

(56) References Cited

U.S. PATENT DOCUMENTS

| | | | | |
|---|---|---|---|---|
| 6,289,762 | B1 | 9/2001 | Silva | |
| 6,330,838 | B1 | 12/2001 | Kalsi | |
| 6,336,377 | B1 | 1/2002 | Reimann et al. | |
| 6,446,526 | B2 | 9/2002 | Reimann et al. | |
| 6,515,473 | B2 | 2/2003 | Pfaffenberger et al. | |
| 6,523,433 | B1 | 2/2003 | Staker | |
| 6,758,114 | B2 | 7/2004 | Sundaresan et al. | |
| 7,404,342 | B2 | 7/2008 | Wurn | |
| 8,011,270 | B2 * | 9/2011 | Schlabach | G05G 1/38 74/512 |
| 8,042,430 | B2 * | 10/2011 | Campbell | G05G 5/03 74/513 |
| 8,534,157 | B2 * | 9/2013 | O'Neill | G05G 1/30 74/512 |
| 9,684,331 | B2 | 6/2017 | Hallberg | |
| 2002/0002873 | A1 | 1/2002 | Yaddehige | |
| 2003/0154817 | A1 | 8/2003 | Staker | |
| 2004/0237700 | A1 * | 12/2004 | Wurn | G05G 1/38 74/514 |
| 2006/0185469 | A1 * | 8/2006 | Schlabach | G05G 1/38 74/560 |
| 2008/0276749 | A1 | 11/2008 | Stewart et al. | |
| 2010/0206122 | A1 * | 8/2010 | Seiltz | G05G 1/38 74/512 |

FOREIGN PATENT DOCUMENTS

| | | | | |
|---|---|---|---|---|
| DE | 102008003296 | B4 * | 4/2016 | G05G 1/38 |
| WO | 2018/039098 | A1 | 3/2018 | |

* cited by examiner

PEDAL FRICTION PAD FOR VEHICLE PEDAL ASSEMBLY

CROSS-REFERENCE TO RELATED APPLICATION

This patent application claims the priority and benefit of the filing date of U.S. Provisional Patent Application Ser. No. 62/725,930 filed on Aug. 31, 2018, the disclosure and contents of which are expressly incorporated herein in their entirety by reference.

FIELD OF THE INVENTION

This invention pertains generally to a vehicle pedal assembly and, more specifically, to a new pedal friction pad for such vehicle pedal assembly.

DESCRIPTION OF THE RELATED ART

The present invention is directed to a vehicle pedal assembly of the type disclosed in for example U.S. Pat. No. 9,684,331 to Hallberg that includes a pedal friction pad or lever in contact with the drum of the pedal for generating a pedal hysteresis force on the pedal.

Currently available pedal friction pads include contact friction surfaces shaped and oriented to provide for either area contact with the friction surface of the pedal drum (i.e., full surface contact between the contact surface of the friction pad and the contact surface of the pedal drum) or point contact with the friction surface of the pedal drum (i.e., point surface contact between a point on the surface of the friction pad and a point on the surface of the pedal drum).

Area contact designs offer increased wear and durability between the contacting pedal pad and friction pad surfaces due to the low pressure at the interface of the pedal pad and friction pad surfaces. Area contact designs however provide decreased initial force consistency due to the potential variance in the location of the area contact.

Point contact designs offer increased initial force consistency because contact is restricted to a single contact point. Point contact designs however offer decreased wear and durability due to the higher pressures concentrated at the single point of contact.

The present invention is directed to a new pedal friction pad providing for a line friction contact between the friction pad surface and the pedal surface that provides increased wear and durability over area contact designs and increased initial force consistency over point contact designs.

SUMMARY OF THE INVENTION

The present invention is directed to a vehicle pedal assembly comprising a pedal housing, a rotatable pedal including a drum extending into the pedal housing, the drum including a friction contact surface, and a pedal friction pad in the housing including a pedal friction surface in contact with the friction contact surface on the drum, the pedal friction surface being shaped and positioned to provide for a line contact between the pedal friction surface and a portion of the friction contact surface on the drum of the pedal.

In one embodiment, the line contact is between an arc-shaped segment of the pedal friction surface of the pedal friction pad and the drum contact surface.

In one embodiment, the line contact is between a lower segment of the arc-shaped segment of the pedal friction surface of the pedal friction pad and the drum contact surface.

In one embodiment, the pedal friction surface includes first, second, and third surface segments, the arc-shaped segment defining the second surface segment and extending between the first and third surface segments.

In one embodiment, the first segment is a curved segment and the third segment is a straight segment.

In one embodiment, the first segment is a converging curved segment and the third segment is a converging straight segment.

In one embodiment, the friction contact surface of the drum is a converging straight surface.

The present invention is also directed to a friction pad for a vehicle pedal, the friction pad comprising a friction surface in a line friction contact with the vehicle pedal.

In one embodiment, the friction surface includes an arc-shaped segment in a line friction contact with the vehicle pedal.

In one embodiment, the friction surface includes first, second, and third surface segments, the arc-shaped segment defining the second surface segment and extending between the first and third surface segments.

In one embodiment, the first surface segment is a converging curved surface segment and the third segment is a straight converging surface segment.

The present invention is further directed to a friction pad for a vehicle pedal, the friction pad comprising a first friction pad surface, a second arc-shaped friction pad surface extending from the first friction surface and in a line frictional contact with the vehicle pedal, and a third friction pad surface extending from the second friction surface.

In one embodiment, the first friction pad surface is a curved converging surface and the third friction surface is a straight converging surface.

In one embodiment, the vehicle pedal includes a straight diverging surface in the line frictional contact with the first friction surface of the friction pad.

In one embodiment, the friction pad includes an over-molded friction member, the first, second, and third friction pad surfaces being formed on the over-molded friction member.

There are other advantages and features of this invention which will be more readily apparent from the following detailed description of the embodiment of the invention, the drawings, and the appended claims.

BRIEF DESCRIPTION OF THE DRAWINGS

In the accompanying drawings that form part of the specification, and in which like numerals are employed to designate like parts throughout the same.

DETAILED DESCRIPTION OF THE EMBODIMENT

Figure 1:
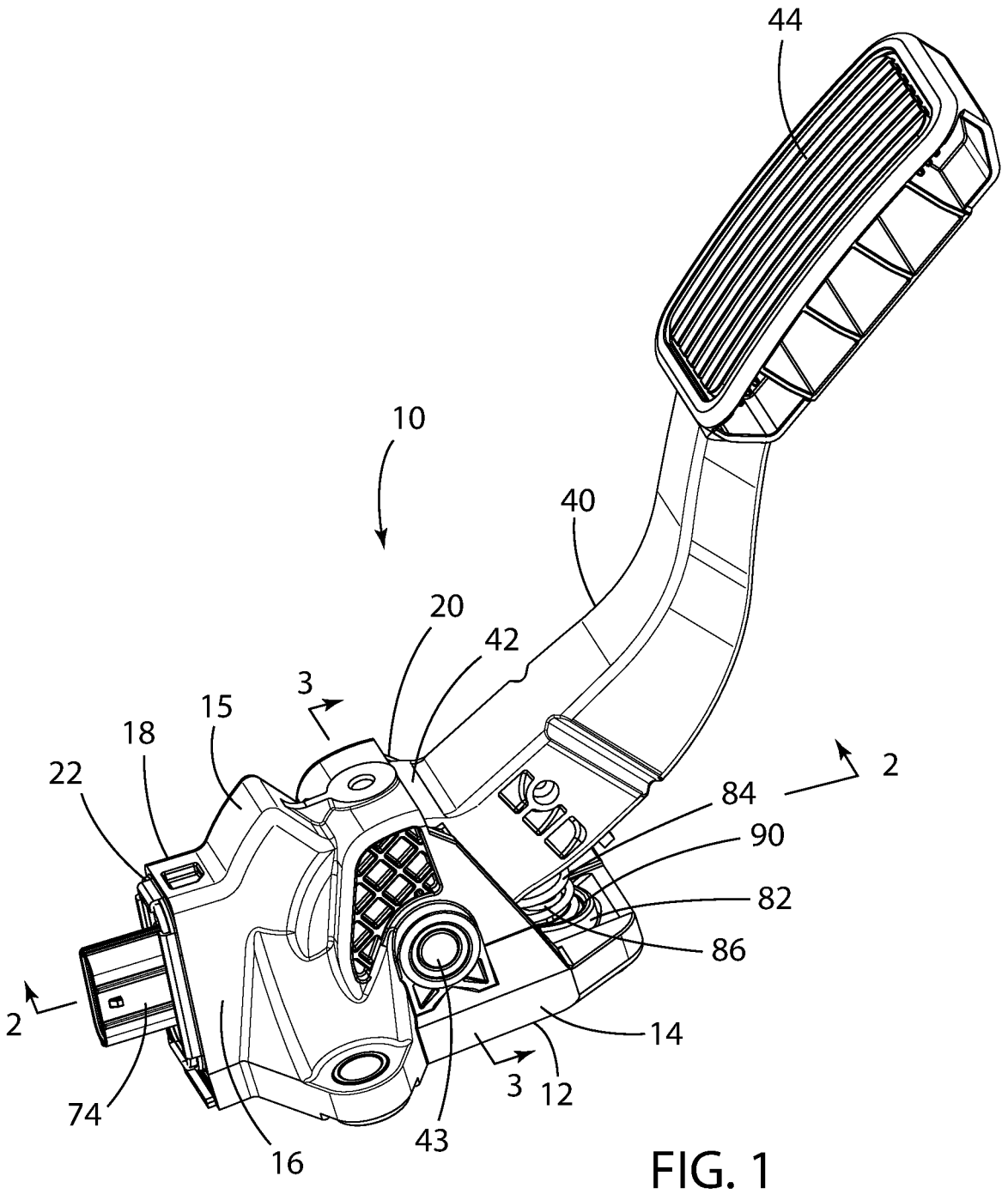
FIG. 1 is a perspective view of a vehicle pedal assembly incorporating a pedal friction pad in accordance with the present invention.
Figure 2:
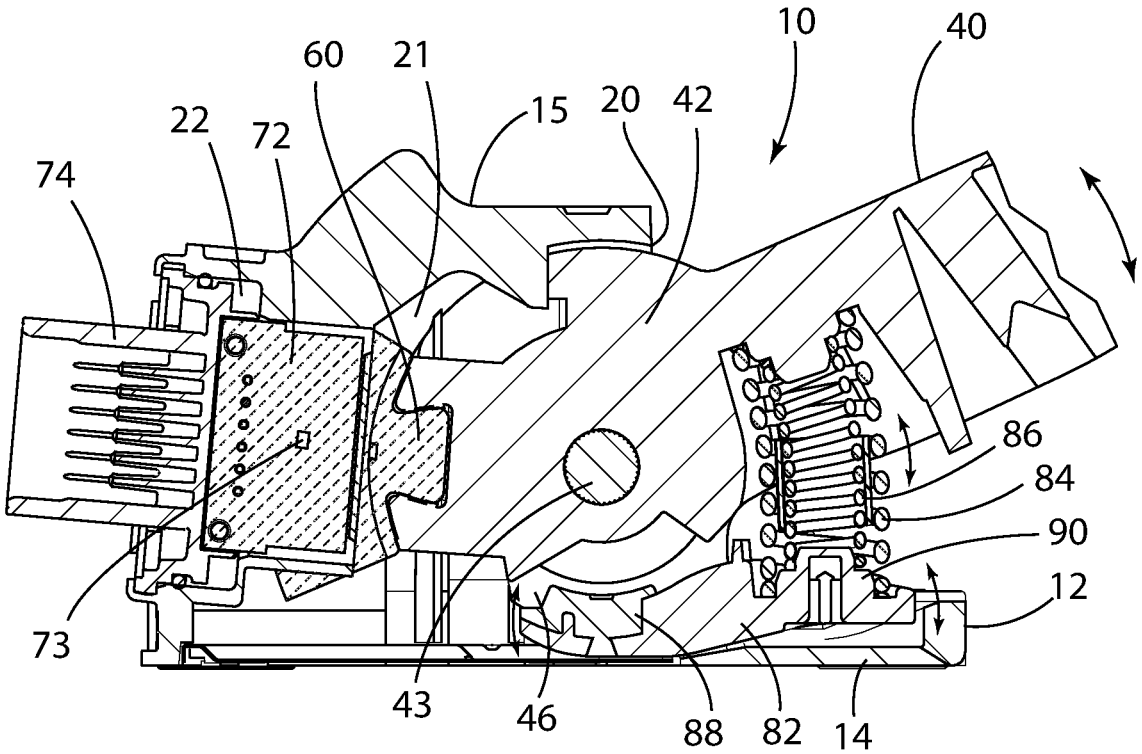
FIG. 2 is a broken longitudinal vertical cross-sectional view of the vehicle pedal assembly taken along the line 2-2 in FIG. 1.
Figure 3:
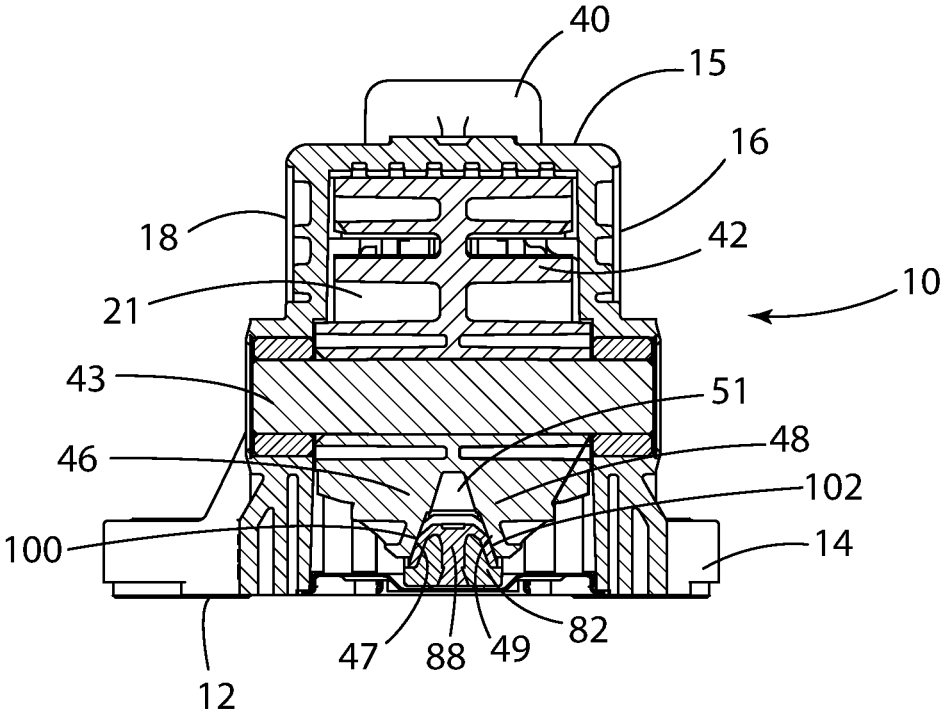
FIG. 3 is a transverse vertical cross-sectional view of the vehicle pedal assembly taken along the line 3-3 in FIG. 1.
Figure 4:
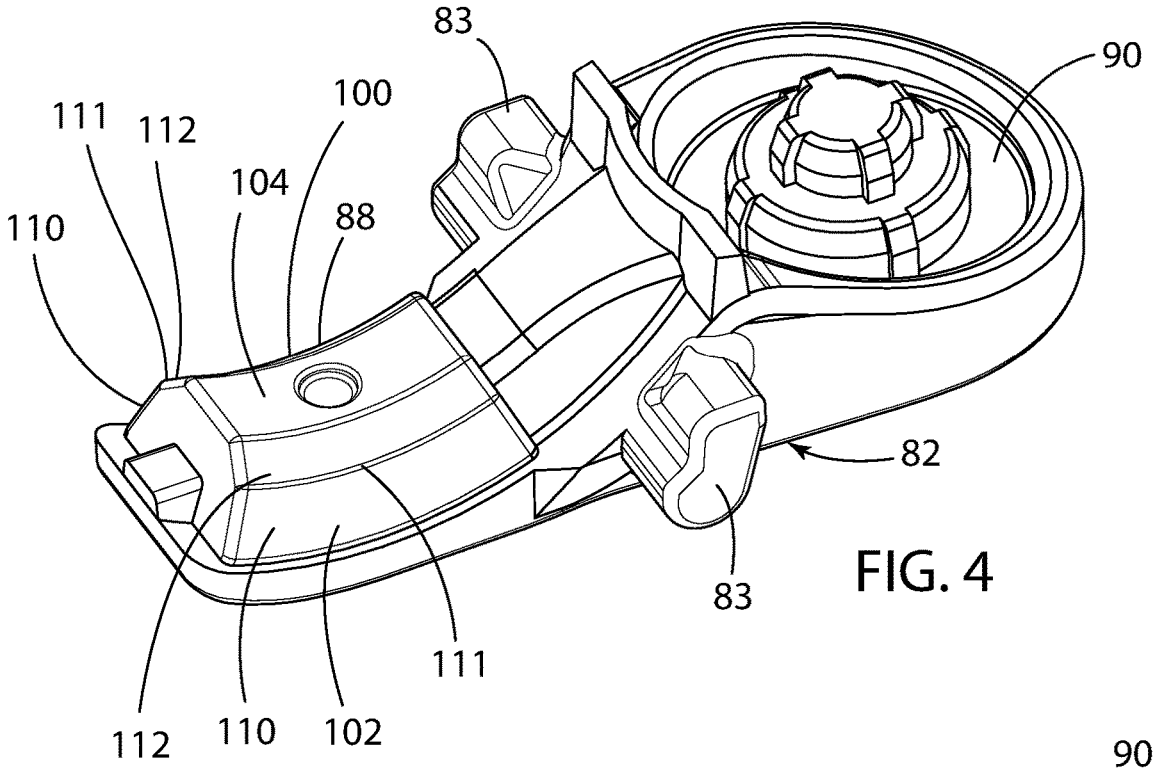
FIG. 4 is an enlarged perspective view of the pedal friction pad in accordance with the present invention.

FIGS. 1, 2, and 3 depict an accelerator vehicle pedal assembly 10 incorporating a pedal friction pad 82 in accordance with the present invention.

The vehicle pedal assembly 10 is of the type shown and described in for example U.S. Pat. No. 9,684,331 to Hallberg, the disclosure and contents of which are expressly incorporated herein by reference as though fully set forth herein.

The vehicle pedal assembly 10 comprises a pedal housing 12 that is made of a suitable molded plastic material such as for example nylon and includes a generally flat base 14, a pair of spaced apart and parallel side walls 16 and 18 extending unitarily and normally outwardly and upwardly from opposed longitudinally extending peripheral lower longitudinal edges of the base 14, and a top curved wall 15 extending unitarily between and normally outwardly from opposed longitudinal upper peripheral edges of the respective side walls 16 and 18 in a relationship above, spaced and opposed to the base 14.

The base 14 and the walls 15, 16, 18 together define and form a front open pedal housing opening 20, an interior hollow pedal housing cavity 21, and a rear open pedal housing opening 22.

The vehicle pedal assembly 10 also comprises an elongated pedal 40 that may be made of the same molded plastic material as the pedal housing 12 and includes a first distal end terminating in and defining a generally cylindrical drum 42 and an opposite distal end terminating in an operator foot pad 44.

The cylindrical drum 42 is located and retained for rotation in the interior pedal housing cavity 21 via a shaft 43 that extends through the interior of the drum 42 and includes opposed ends secured in the respective pedal housing side walls 16 and 18. The drum 42 includes a pair of lower diametrically opposed and spaced apart friction contact walls 46 and 48 extending outwardly and downwardly from a lower portion of the drum 42 in the direction of the base 14 of the pedal housing 12.

The walls 46 and 48 include respective straight interior friction contact faces or surfaces 47 and 49 that diverge and slope away from each other in the direction of the base 14 of the pedal housing 12. The walls 46 and 48 together with the respective interior friction faces or surfaces 47 and 49 thereof define a generally V-shaped region or void 51 between the walls 46 and 48 that opens in the direction of the base 14 of the pedal housing 12.

The vehicle pedal assembly 10 further comprises a non-contacting pedal position sensing assembly including a magnet 60 extending outwardly from the front of the drum 42 of the pedal 40 in the direction of the rear pedal housing opening 22 and located in the interior pedal housing cavity 21.

The non-contacting pedal position sensing assembly further includes a sensor 73 mounted on the exterior face or surface of a printed circuit board 72 located in the interior housing cavity 21 between the rear pedal housing opening 22 and the magnet 60.

The printed circuit board 72 in turn is coupled to the end of an electrical connector 74 that is separate from and protrudes outwardly from the rear housing opening 22. The sensor 73 may be, for example, of the Hall Effect type, and adapted to sense a change in the magnitude or direction of the magnetic flux generated by the magnet 60 in response to a change in the rotational position of the drum 42 and the pedal 40 relative to the pedal housing 12 in response to the depression and rotation of the pedal 40 as described in more detail below.

The vehicle pedal assembly 10 still further comprises a pedal friction or hysteresis assembly including an elongate pedal friction or hysteresis lever or friction pad 82 which may be made of a suitable molded plastic material. The friction pad 82 includes an exterior over-molded friction surface insert or member 88 at one distal end thereof adapted for engagement and frictional abutting contact with the friction contact surfaces 47 and 49 of the respective pedal drum walls 46 and 48 as described in more detail below.

A cup or receptacle 90 is defined and formed at the opposed distal end of the pedal friction pad 82 and is adapted to receive the lower ends of telescoping helical springs 84 and 86. The telescoping helical springs 84 and 86 extend between the pedal friction pad 82 and the underside of the pedal 40 and include respective upper spring ends seated and abutted against the underside of the pedal 40.

The pedal friction pad 82 also includes a pair of co-linear and diametrically opposed and spaced apart trunnions or pins 83 that project unitarily outwardly from the opposed exterior side surfaces of the lever or pad 82 and are adapted to be received in respective diametrically opposed and spaced cheeks or recesses (not shown) defined and formed in the pedal housing 12.

The pins 83 define a teeter totter type pivot axis for the friction lever or pad 82 relative and about the housing 12 and, more specifically, a pivot axis for the pedal friction lever or pad 82 relative and about the base 14 of the pedal housing 12. The pins 83 and the pivot axis defined by the pins 83 extend in a transverse direction normal to the direction of the longitudinal axis of the friction lever 82.

The application of a downward depression force against the pedal foot pad 44 causes the clockwise rotation of the pedal 40 and the drum 42 relative to the pedal housing 12 and the pedal shaft 43 which causes the compression of the helical springs 84 and 86 which in turn causes a teeter totter type downward pivoting of the end of the friction lever or pad 82 with the cup 90 about the pins 83 and relative to the base 14 of the pedal housing 12 which in turn causes an upward movement of the end of the friction lever or pad 82 with the friction member 88 which in turn causes the friction member 88 into abutting frictional contact and engagement with the drum 42 of the pedal 40 and exert a compressive frictional force against the exterior surface of the drum 42, and more specifically, to exert a compressive frictional force against the respective friction contact surfaces 47 and 49 of the respective friction contact walls 46 and 48 of the drum 42 of the pedal 40 which in turn generates a hysteresis force that is transferred to the pedal 40 and the foot (not shown) of the operator (not shown) of the vehicle (not shown).

Rotation of the pedal 40 relative to the housing 12 as described above also results in the rotation of the magnet 60 which in turn results in a change in the magnitude and direction of the magnetic flux generated by the magnet 62 that is sensed by the Hall Effect sensor 70 and allows detection and measurement of the position of the pedal 40 relative to the housing 12 thus allowing for the control of the acceleration and deceleration of the vehicle.

In accordance with the present invention, and as shown in more detail in FIGS. 4, 5, 6, and 7, the friction member 88 on the pedal friction pad 82, which in the embodiment shown is in the form an over-molded insert that is separate from and molded onto the top of the pad 82, is configured and shaped to provide a line friction contact between the friction member 88 and the respective friction contact faces 47 and 49 of the respective pedal drum friction contact walls 46 and 48 as described in more detail below.

In particular, the pedal pad friction member or insert 88 includes a pair of diametrically opposed converging friction side surfaces or faces 100 and 102 and a straight horizontal central surface or face 104 therebetween. The surfaces 100 and 102 converge towards each other in the direction of the surface 104 and the pedal drum 42.

Each of the diametrically opposed converging friction side surfaces 100 and 102 in turn include a first lower curved surface or face segment 110 extending and sloping upwardly and converging inwardly from a base of the friction pad 82, a second curvilinear or arc-shaped surface or segment 111 extending unitarily upwardly and inwardly from an upper end of the surface or face segment 110, and a third upper straight surface or face segment or portion 112 extending upwardly and converging inwardly from the end of the curvilinear or arc-shaped surface or segment 111.

In the embodiment shown, the first lower surface segment 110 including the upper portion 112 is curvilinear in shape and more specifically is a surface segment which curves upwardly and inwardly away from the base of the pedal friction pad 82. In the embodiment shown, the second curvilinear or arc-shaped surface or segment 111 is located and formed between the lower surface segment 110 and the upper surface segment 111 of the respective surfaces 100 and 102 of the pedal friction pad surface or insert 88. In the embodiment shown, the third straight horizontal surface or segment 104 extends between the upper ends of the opposed surfaces 100 and 102 and, more specifically, between the ends of the respective opposed upper end segments 112 of the respective surfaces 100 and 102.

Figure 5:
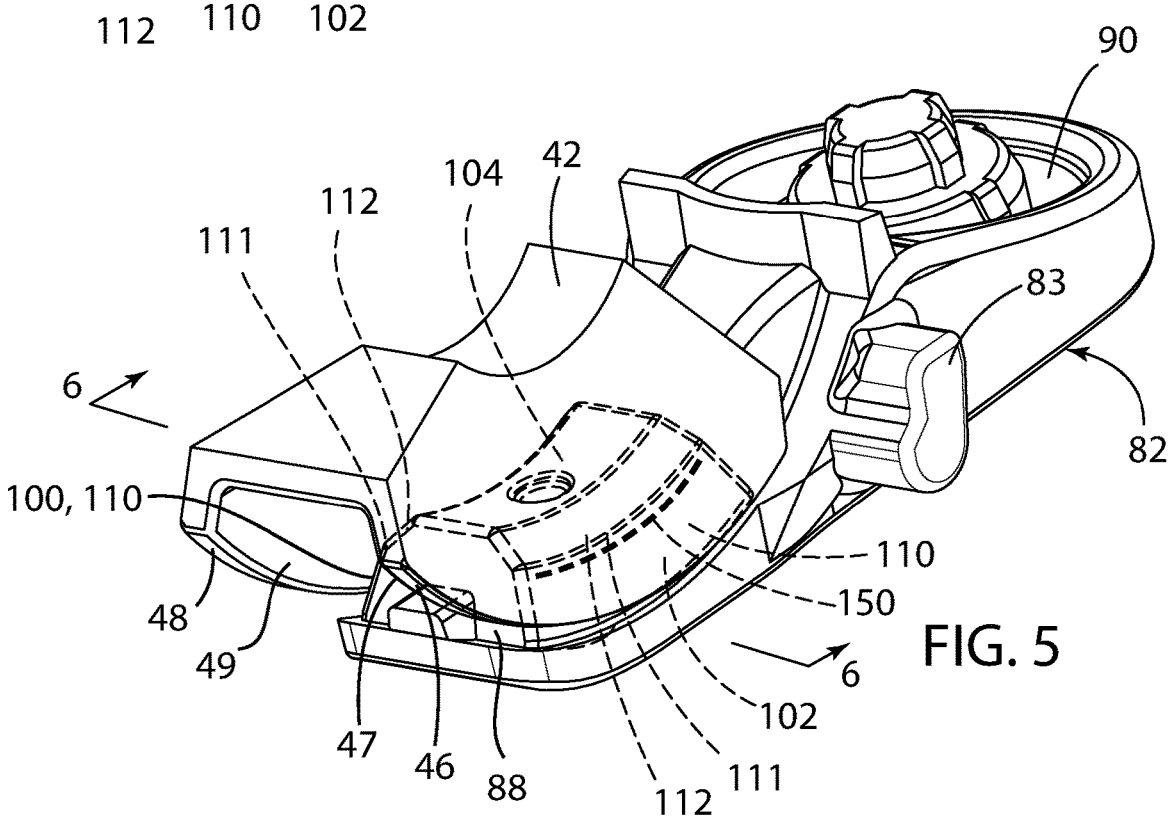
FIG. 5 is an enlarged broken perspective view depicting the line contact between the friction pad surface and the pedal drum friction surface.
Figure 6:
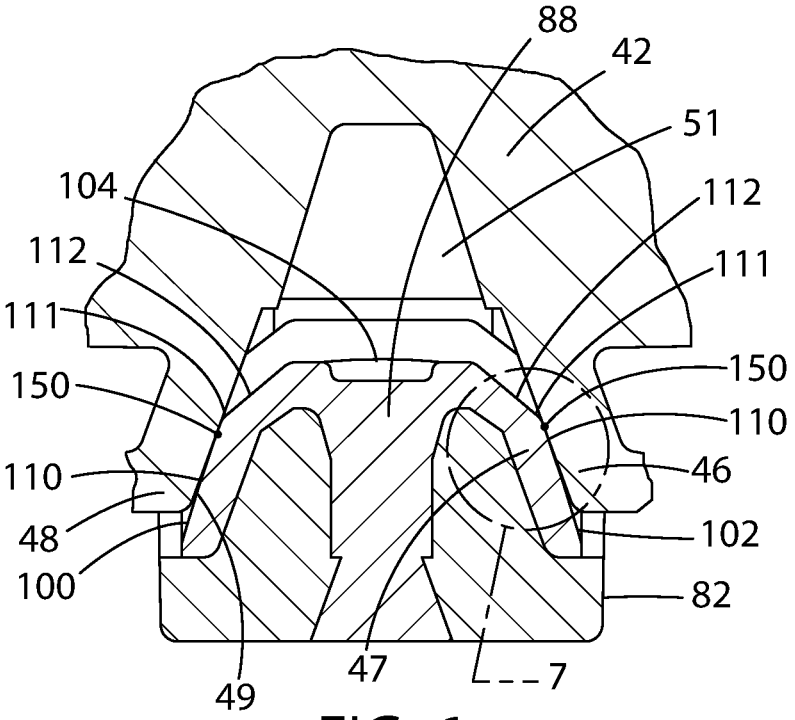
FIG. 6 is an enlarged broken simplified transverse vertical cross-sectional view taken along the line 6-6 in FIG. 5 depicting the line contact between the friction pad surface and the pedal drum friction surface.
Figure 7:
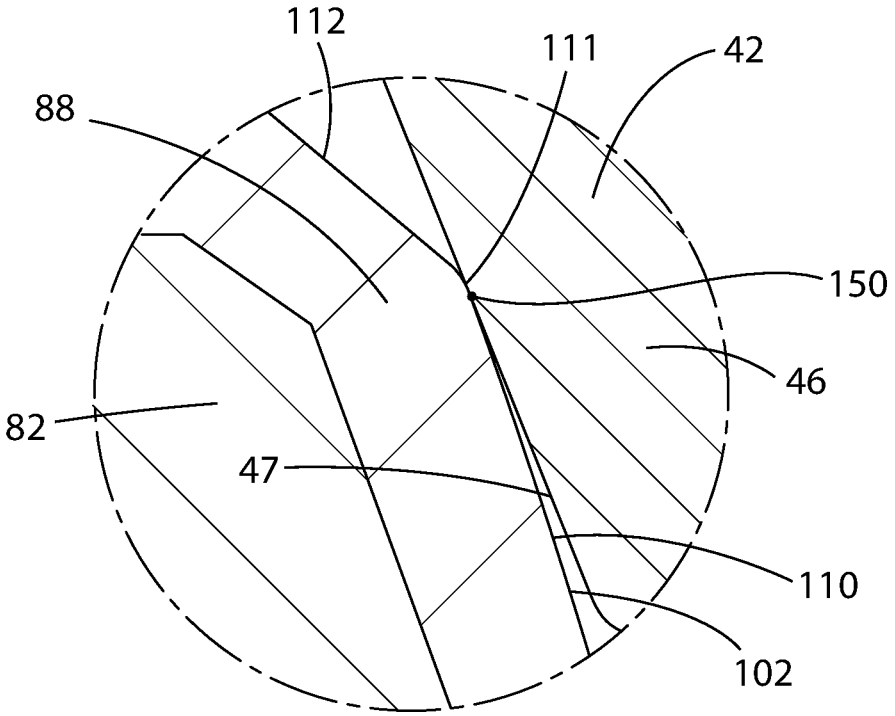
FIG. 7 is a further enlarged broken simplified transverse vertical cross-sectional view depicting the line contact between the friction pad surface and the pedal drum friction surface

The surface segments 110, 111, and 112 of the respective surfaces 100 and 102 of the friction insert or member 88 of the friction pad or lever 82 are shaped, positioned, and oriented relative to each other to allow and provide and define a curved line friction contact, generally designated by the point 150 in the cross-sectional views of FIGS. 6 and 7 and the curved dotted line 150 in the perspective view of FIG. 5, between the friction member 88 of the pedal friction pad or lever 82 and a portion or segment of the respective friction contact faces 47 and 49 of the respective friction contact walls 46 and 48 on the pedal drum 42.

Specifically, in the embodiment shown, the surface segments 110, 111, and 112 of the respective surfaces 100 and 102 of the friction insert or member 88 of the friction pad or lever 82 are shaped, positioned, and oriented relative to each other to provide for a longitudinally extending line of friction contact 150 between a lower longitudinally extending segment of the curvilinear or arc-shaped surface or segment 111 of the respective surfaces 100 and 102 and a longitudinally extending segment of the respective surfaces 47 and 49 of the respective drum walls 46 and 48 of the drum 42 of the pedal 40.

Still more specifically, in the embodiment as shown in FIGS. 5, 6, and 7, the friction contact line 150 between the friction member 88 and the drum 42 extends longitudinally between respective front and back edges of the friction insert or member 88 of the friction pad or lever 82 and the respective drum contact surfaces 47 and 49.

It is understood of course that the invention encompasses any other shape or position or configuration of the pedal friction member 88 and/or the pedal drum surfaces that provides for a line frictional contact between the respective friction surfaces of the pedal friction pad 82 and the friction contact surfaces 47 and 49 of the friction contact walls 46 and 48 of the pedal drum 42.

For example, it is understood that the angle or slope of the friction surfaces 47 and 49 on the friction walls 46 and 48 of the pedal drum 42 can be varied or adjusted to adjust or vary the pedal hysteresis force generated by the friction pad or lever 82 on the drum 42.

It is also understood for example that the orientation, shape, configuration or location of the friction pad 82 and/or the respective surfaces 102 and 104 thereof and/or the drum 42 and/or the respective surfaces 47 and 49 or walls 46 and 48 can be varied to cause the vertical or transverse movement of the contact line 150, which is shown in FIG. 5 as being adjacent and generally parallel to the longitudinal pad surface segment 111, either closer to the pad surface segment 111 or further from the pad surface segment 111 and closer to the base of the pad 82 (i.e. adjusting the vertical or transverse location of the longitudinally extending contact line 150 on the pad surface segment 110) for varying or adjusting the pedal hysteresis force.

Numerous variations and modifications of the embodiment of the pedal friction pad 82 and the pedal friction member 88 thereof as described above may be effected without departing from the spirit and scope of the novel features of the invention. It is to be further understood that no limitations with respect to the pedal friction pad illustrated herein are intended or should be inferred. It is, of course, intended to cover by the appended claims all such modifications as fall within the scope of the claims.

What is claimed is:

1. A vehicle pedal assembly comprising:

a pedal housing;

a rotatable pedal including a drum extending into the pedal housing, the drum including a friction contact surface; and a pedal friction pad in the housing including a pedal friction surface opposed to and facing the friction contact surface on the drum, the pedal friction surface being shaped and positioned to provide for a line contact between the pedal friction surface and a portion of the friction contact surface on the drum of the pedal, the pedal friction surface including a plurality of friction surface segments opposed to and facing the drum of the pedal, and the line contact is between only one of the plurality of the friction surface segments of the pedal friction surface of the pedal friction pad and the drum contact surface.

2. The vehicle pedal assembly of claim 1, wherein the line contact is between a lower segment of an arc-shaped segment of the plurality of friction surface segments of the pedal friction surface of the pedal friction pad and the drum contact surface.

3. The vehicle pedal assembly of claim 1, wherein the pedal friction surface includes first, second, and third surface segments opposed to and facing the drum contact surface, the second surface segment extending between the first and third surface segments and the line contact is between only the second surface segment of the pedal friction surface of the pedal friction pad and the drum contact surface.

4. A vehicle pedal assembly comprising:

a pedal housing;

a rotatable pedal including a drum extending into the pedal housing, the drum including a friction contact surface; and a pedal friction pad in the housing including a pedal friction surface in contact with the friction contact surface on the drum, the pedal friction surface being shaped and positioned to provide for a line contact between the pedal friction surface and a portion of the friction contact surface on the drum of the pedal, the line contact being between an arc-shaped segment of the pedal friction surface of the pedal friction pad and the drum contact surface, the pedal friction surface includes first, second, and third surface segments, the arc-shaped segment defining the second surface segment and extending between the first and third surface segments and wherein the first segment is a curved segment and the third segment is a straight segment.

5. The vehicle pedal assembly of claim 4, wherein the first segment is a converging curved segment and the third segment is a converging straight segment.

6. The vehicle pedal assembly of claim 5, wherein the friction contact surface of the drum is a converging straight surface.

7. A friction pad for a vehicle pedal, the friction pad comprising a friction surface in a line friction contact with the vehicle pedal, the friction surface including an arc-shaped segment in a line friction contact with the vehicle pedal, the friction surface including first, second, and third surface segments, the arc-shaped segment defining the second surface segment and extending between the first and third surface segments and wherein the first surface segment is a converging curved surface segment and the third segment is a straight converging surface segment.

8. A friction pad for a vehicle pedal, the friction pad comprising:

a first friction pad surface opposed to and facing a friction contact surface of the vehicle pedal;

a second arc-shaped friction pad surface opposed to and facing the friction contact surface of the vehicle pedal and extending from the first friction surface and in a line frictional contact with the friction contact surface of the vehicle pedal; and a third friction pad surface extending from the second friction surface and opposed to and facing the friction contact surface of the vehicle pedal, wherein the first friction pad surface is a curved converging surface and the third friction surface is a straight converging surface.

* * * * *